United States Patent [19]

Esslinger

[11] Patent Number: 4,860,856

[45] Date of Patent: Aug. 29, 1989

[54] OIL PRESSURE ADJUSTMENT DEVICE FOR ENGINES

[76] Inventor: Dwaine E. Esslinger, 712 Montecito, San Gabriel, Calif. 91733

[21] Appl. No.: 212,513

[22] Filed: Jun. 28, 1988

[51] Int. Cl.[4] ..... F01M 1/18; F01M 49/08

[52] U.S. Cl. ..... 181/6.4; 417/307; 417/311; 137/538

[58] Field of Search ..... 184/6.5; 417/307, 311, 417/308, 310; 137/538

[56] References Cited

U.S. PATENT DOCUMENTS

| | | | |
|---|---|---|---|
| 1,986,299 | 1/1935 | Steven | 417/307 |
| 3,490,481 | 1/1970 | Heath, Jr. | 417/311 |
| 4,168,721 | 9/1979 | Mueller, Jr. | 137/538 |
| 4,512,298 | 4/1985 | Hayashi | 184/6.5 |
| 4,718,450 | 1/1988 | Ezekoye | 137/538 |

*Primary Examiner*—Leonard E. Smith
*Assistant Examiner*—Robert N. Blackmon
*Attorney, Agent, or Firm*—Boniard I. Brown

[57] ABSTRACT

In an engine lubrication an external bypass mechanism for venting pressurized liquid around the lubricated areas, whereby the high side pressure is maintained within a desired range. The bypass mechanism includes a pressure regulator that has variable pressure setting.

3 Claims, 1 Drawing Sheet

OIL PRESSURE ADJUSTMENT DEVICE FOR ENGINES

BACKGROUND OF THE INVENTION

Lubrication systems for piston engines can sometimes fail to maintain satisfactory pressure in the high side of the system, due for example to pump wear to excessive tolerances on pump components, or worn piston rings, high operating temperatures (low oil viscosity), worn bearings, or excessive pressure drops through oil filters or oil coolers. My invention relates to a mechanism for maintaining satisfactory high side pressure in spite of adverse factors of the above-mentioned type.

SUMMARY OF THE INVENTION

My invention contemplates the use of an unregulated oil pump that develops a relatively high pressure in the high side of the lubrication system. I add to the system a bypass line that goes from the high side around the engine and back to the sump. A pressure-relief valve is arranged in the bypass line to open the line only when the high side pressure becomes excessively high; at other times the relief valve is closed to maintain a satisfactory high side pressure.

A primary feature of the pressure-relief valve is adjustability of the pressure at which the valve begins to discharge liquid back to the sump. The pressure setting can be adjusted to keep pace with operating variables, such as pump wear, engine wear, or operating temperature variations.

The valve and bypass line are located external to the engine. Therefore, the valve and bypass line can be readily added to existing engines without major engine modifications.

THE DRAWINGS

DESCRIPTION OF A PREFERRED EMBODIMENT OF THE INVENTION

Figure 1:
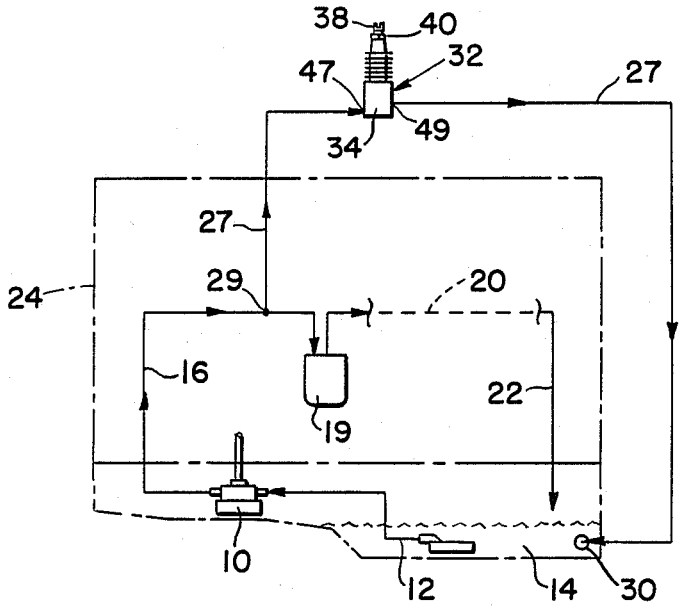
FIG. 1 is a diagram of an engine lubrication system modified to incorporate my invention.

FIG. 1 diagrammatically shows an engine lubrication system embodying my invention. An oil pump 10 has an intake line 12 reaching into oil pan (sump) 14 to transport oil through high pressure line 16. The pressurized oil passes through oil filter 19 and then into the various sliding interfaces in the engine requiring lubrication, e.g. main bearings, piston rings, valves, etc. In FIG. 1 the lubricated engine components are collectively referenced by numeral 20.

Low pressure lubricant is discharged from the engine back to sump 14 via the crankcase and various passages, collectively referenced by numeral 22. In FIG. 1 nuberal 24 references the engine block, whereas numeral 14 references the sump. The lubrication system thus far described is conventional.

My invention relates to an add-on system designed to maintain a satisfactory pressure in the high side of the system (i.e. in line 16) in spite of adverse factors that might tend to raise or lower the pressure outside the satisfactory range. My add-on system comprises a bypass line 27 that extends from high pressure line 16 around the lubricated componentry 20 and back to sump 14. Line 27 can connect to line 16 before or after filter 19. The bypass line is external to the engine cylinder block so that it can be installed on the engine by connecting into only two points on the engine, i.e. an inlet T connection 29 and an outlet sump connection 10.

Figure 2:
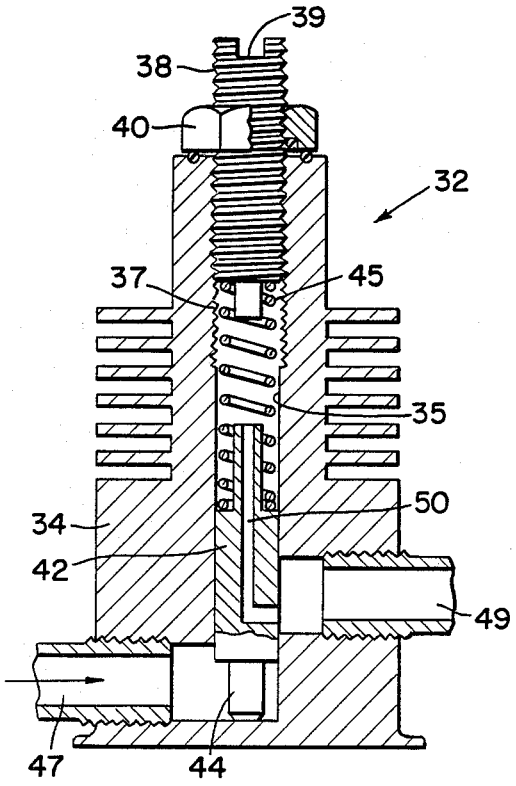
FIG. 2 is a sectional view through a pressure-relief valve used in the FIG. 1 lubrication system.
Figure 3:
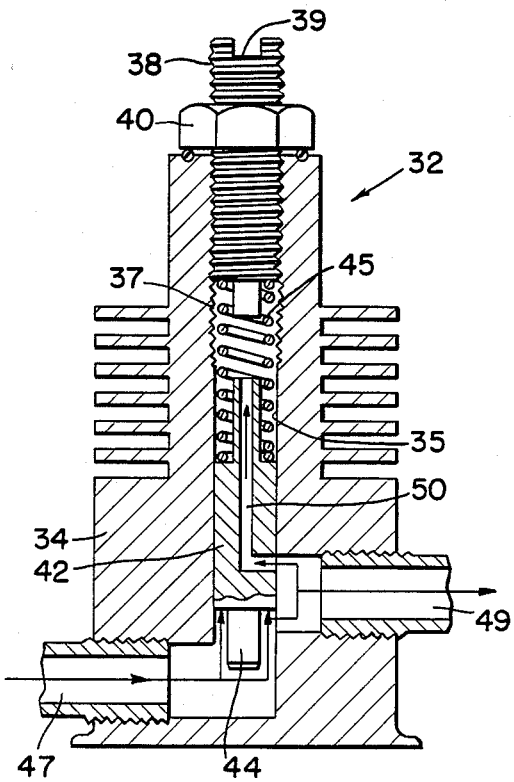
FIG. 3 is a view similar to FIG. 2, but showing the valve in a different condition (open rather than closed).

A pressure-relief valve 32 is operatively located in bypass line 27 to discharge pressurized liquid to sump 14 when the pressure in line 16 exceeds a predetermined value. This predetermined pressure is adjustable. The details of valve 32 are shown in FIGS. 2 and 3.

Valve 32 comprises a housing 34 having a cylindrical bore 35 extending downwardly from its upper face. Screw threads 37 are formed in the outer (upper) end of bore 35 to rotatably receive a set screw 38. A lock nut 40 may be threaded onto screw 38 to lock it in different positions of axial adjustment along bore 35.

A flow control piston 42 is slidably positioned in the unthreaded portion of bore 35 near its blind (closed) end. Reduced diameter piston extension 44 prevents the piston from movement downwardly beyond the FIG. 2 position. A compression spring 45 is trained between screw 38 and piston 42 to apply a downwardly-acting force on the piston in opposition to a liquid force continually existing on the piston lower end face.

An inlet passage (or chamber) 47 communicates with the blind end of bore 35, such that pressure in high pressure line 16 is applied to the lower end face of piston 42. An outlet passage 49 communicates with a point on bore 35 spaced axially above the inlet passage communication point, whereby piston 42 blocks any communication between inlet passage 47 and outlet passage 49 when the piston is in its FIG. 2 position.

The position of piston 42 in bore 35 is determined by the relative magnitudes of the two opposition forces, i.e. the spring 45 force and the inlet passage force. When (if) the liquid pressure force (in passage 47) exceeds the spring force piston 42 will move upwardly to the FIG. 3 position (and possibly higher), to permit liquid communication between the two passages 47 and 49. Pressurized liquid is then discharged through passage 49 and eventually back to sump 14, to relieve the excessively high pressure condition in line 16. When the high pressure condition is relieved piston 42 returns to its FIG. 2 position blocking liquid flow through the bypass line.

Proper operation of piston 42 necessitates that the space above the piston be essentially liquid depressurized; a solid immovable block of trapped oil above the piston would prevent piston movement to the FIG. 3 position. Accordingly, I provide an L-shaped pressure-equalization passage 50 in the piston. One leg of this passage is exposed to the spring chamber, while the other leg is exposed to outlet passage 49. The pressure-equalization passage could be formed in housing 34.

An important feature of my invention is set screw 38 (acting as a seat for spring 45). Manual rotation of the screw moves the screw axially along the threaded section of bore 35 (up or down), to thereby vary the force that the spring develops on piston 42. By varying the spring force it is possible to vary the pressure setting for the valve, i.e. the pressure at which piston 42 permits liquid to flow from passage 47 into passage 49.

The drawing shows screw 38 with a slot 39 for direct manual turning purposes. However it is possible to provide for remote turning control, e.g. with a servo motor drive to screw 38.

My invention works to best advantage if pump 10 is permitted to have an unregulated output flow through line 16. Therefore, when my invention is applied to existing power plants the pressure regulator portion of the pump is preferably removed to provide full flow through line 16. Pressure regulation is then achieved solely with valve 34. Since valve 34 has a variable pressure setting it can provide a range of output pressures that is not attainable with a conventional regulator built into the pump.

The invention can be incorporated into existing piston engine power plants at relatively small cost. The valve portion of the hardware can be relatively small physically such that it can be located in different areas, wherever space is available. The invention can be used in a variety of different installations, e.g. aircraft engines, boat engines, car and truck engines, etc.

I claim:

1. In combination with an engine lubrication system having a high side and a low side, the improvement comprising:

a bypass means extending from the high side around the lubrication system to the low side, said bypass means including a pressue-responsive valve operable to pass liquid through the bypass means when the high side pressure is above a predetermined value, said pressure-responsive valve comprising a housing having a bore extending from one of its faces, threads formed in the outer end area of the bore, a flow control piston slidably positioned in an unthreaded portion of the bore, a set screw threaded into the threaded area of the bore, a compression spring trained between the set screw and the piston for biasing the piston toward the blind end of the bore, an inlet passage extending into the housing in liquid communication with the blind end of the bore, and an outlet passage extending into the housing to communicate with a point on the bore spaced axially from the inlet passage communication point, whereby movement of the piston away from the blind end of the bore brings the outlet passage into liquid communication with the inlet passage, and an L-shaped pressure-equalization passage in the piston to maintain the space occupied by the spring at the same pressure as the outlet passage, said L-shaped passage having one leg exposed to the space occupied by the spring and the other leg exposed to the outlet passage.

2. A pressure relief valve comprising:

a housing having a bore extending from one of its faces, screw threads formed in the outer end area of the bore, a flow control piston slidably positioned in an unthreaded portion of the bore, a set screw threaded into the threaded area of the bore, a compression spring trained between the set screw and the piston for biasing the piston toward the blind end of the bore, an inlet passage defined in the housing in liquid communication with the blind end of the bore, an outlet passage extending into the housing to communicate with a point on the bore spaced axially from the inlet passage communication point, whereby movement of the piston away from the blind end of the bore brings the outlet passage into the liquid communication with the inlet passage, and an L-shape pressure-equalization passage formed in the piston, said L-shaped passage having one leg exposed to the space occupied by the spring and the other leg exposed to the outlet passage.

3. In combination with an engine lubrication system including a lubricant pump having an unregulated output, a high pressure line from the pump to the engine surfaces requiring lubrication, and a sump for storing liquid lubricant, the improvement comprising:

an external bypass means extending from the high pressure line about the lubrication system and back to the sump, said bypass means including a pressure-responsive relief valve, a single pressurized bypass line extending from the system high pressure line to said pressure-responsive valve, and a single pressure-free line extending from the valve to the sump, said pressure-responsive valve comprising a housing having an inlet chamber connected to said pressurized bypass line, an outlet chamber connected to said pressure-free line, and a straight-sided bore interconnecting the two chambers, a flow-control piston slidably mounted in said bore to block communication between the two chambers except when the inlet chamber pressure exceeds a predetermined value, an adjustable set screw threaded into said bore in axial alignment with the piston; a compression spring trained between the set screw and the piston for biasing said piston toward a position blocking flow from the inlet chamber to the outlet chamber, and a single pressure-equalization passage continually communicating between the bore space occupied by the spring and the outlet chamber, said piston having an imperforate end face exposed to the inlet chamber, whereby the piston completely prevents any flow between the inlet chamber and the space occupied by the spring, said set screw being adjustable to vary the force developed by the spring on the piston, whereby a satisfactory pressure can be maintained in the engine lubrication system in spite of pump wear or other engine conditions affecting the lubrication system pressure.

* * * * *